United States Patent [19]

Fildan

[11] Patent Number: 4,631,784

[45] Date of Patent: Dec. 30, 1986

[54] BUCKLE FOR SECURING A STRAP OR THE LIKE

[76] Inventor: Gerhard Fildan, Kriehubergasse 31, A-1050 Vienna, Austria

[21] Appl. No.: 677,821

[22] Filed: Dec. 4, 1984

[30] Foreign Application Priority Data

Dec. 5, 1983 [AT] Austria ..... 4238/83

[51] Int. Cl.[4] ..... A44B 11/12

[52] U.S. Cl. ..... 24/170; 24/191; 24/585; 24/643

[58] Field of Search ..... 24/643, 646, 647, 585, 24/584, 191, 170

[56] References Cited

U.S. PATENT DOCUMENTS

| | | | |
|---|---|---|---|
| 631,669 | 8/1899 | Rankin | 24/170 X |
| 939,902 | 11/1909 | Garrison | 24/585 X |
| 1,072,498 | 9/1913 | Redmond | 24/585 |
| 1,096,787 | 5/1914 | Kraetzer | 24/585 |
| 3,608,158 | 9/1971 | Bengtsson | 24/170 |
| 3,775,813 | 12/1973 | Higuchi | 24/646 X |
| 3,872,554 | 3/1975 | Wolfertz et al. | 24/191 X |
| 4,233,713 | 11/1980 | Berg | 24/170 X |

FOREIGN PATENT DOCUMENTS

| | | | |
|---|---|---|---|
| 650941 | 10/1937 | Fed. Rep. of Germany | 24/170 |

*Primary Examiner*—William E. Lyddane
*Assistant Examiner*—Laurie K. Cranmer
*Attorney, Agent, or Firm*—Karl F. Ross; Herbert Dubno

[57] ABSTRACT

The buckle consists of a buckle body, an angled buckle cover and a slider. The buckle cover is provided with a plate for engaging a band that is to be fixed. Cheeks protrude from the longitudinal edges of the plate. The angled buckle cover is movably mounted in the cheeks. When the cover is in its closed position, a shorter arm of the cover extends into a recess, which extends transversely to the longitudinal direction of the plate. The shorter arm of the buckle cover selectively holds the belt or the slider in position. For this purpose the slider has an aperture for latching the shorter arm. The shorter arm of the cover extending into the recess in the plate is shorter than the clearance between the cheeks.

3 Claims, 10 Drawing Figures

BUCKLE FOR SECURING A STRAP OR THE LIKE

SUMMARY OF INVENTION

The buckle consists of a buckle body comprising a plate for engagement with a belt to be fixed, and laterally protruding cheeks, in which an angled buckle cover is movably mounted. A shorter arm protrudes from the cover and when the latter is closed extends into a recess, which extends transversely to the longitudinal direction of the plate. The shorter arm of the buckle cover selectively holds the band or a slider, which has an aperture for latching the shorter arm.

This invention relates to a buckle comprising a buckle body having a plate for engaging a belt that is to be fixed, and laterally protruding cheeks, in which an angled buckle cover is movably mounted. When the buckle cover is closed, a shorter arm of the cover extends into a recess, which extends transversely to the longitudinal direction of the plate.

The buckle is mainly intended for use on jackets worn by surfers during windsurfing. Such jackets are held to the body of the surfer by belts. It is desired to provide a buckle which can be adjusted on the belt and closed quickly and in a simple manner. Another desire is to eliminate the need for a readjustment of buckles when they have been adjusted to the body of a given surfer so that it is sufficient merely to close the buckles when the jacket has been put on. The buckle in accordance with the invention can also be used with brassieres for breast-feeding mothers.

To permit the buckle to be quickly and reliably fixed to a band it is a feature of the invention that in a buckle of the kind mentioned first hereinbefore the shorter arm of the buckle cover is adapted to selectively hold a band in position or a slider which has an aperture for latching the shorter arm.

BRIEF DESCRIPTION OF THE DRAWING

Further details of the invention will be explained more fully with reference to the drawing, which shows two embodiments of the buckle in accordance with the invention.

SPECIFIC DESCRIPTION

Figure 9:
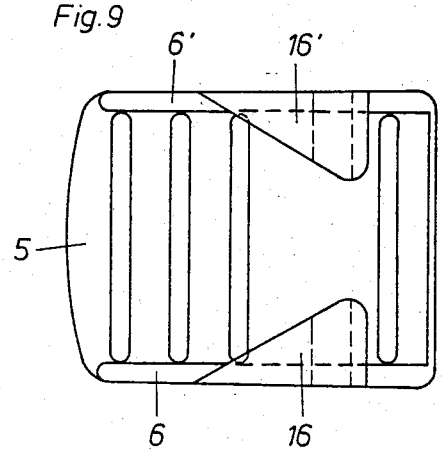
FIG. 9 is a top plan view showing a second embodiment of the buckle body.

As is apparent from the drawing the buckle in accordance with the invention comprises a buckle body 1 and a cover 2. The latter consists of a bell crank lever having a long arm 3, which is manually operable by the wearer to actuate the cover 2, and a shorter arm 4 extending at right angles to the long arm 3. The buckle body 1 comprises a plate 5, which engages at least one of the two bands to be fixed, which are not shown. Cheeks 6,6' extend from the side edges of the plate 5 at right angles to the latter. Each of said cheeks has generally the configuration of a triangle having rounded corners, a base joining the side edge of the plate and lateral sides of different length which include an obtuse angle with each other. The longer lateral side of the triangle slopes toward the forward end of the plate 5 and the shorter lateral side slopes toward the rear end of the plate 5. Each of the cheeks 6,6' is formed with a hole 7,7' adjacent to the rounded corner, which is defined by both lateral sides. The cover 2 is movably mounted in said holes by means of pins 8,8', which protrude adjacent to the corner that is defined by the two arms 3,4. As is apparent from FIGS. 9 and 10 the cheeks 6,6' may be formed with projections 16,16', which are directed toward each other and which taper toward the forward end of the plate 5 so that the space between the projection increases in width in that direction. Besides, the projections 16,16' taper in width in downward direction, as is apparent from FIG. 10, and the cover 2 has in that region a width a corresponding to the largest clearance between the two wedges 16,16' so that the long arm 3 of the cover 2 as it is opened will force the wedges apart and under their spring action will return to its closed position when the cover has been released. The wedges 16,16' are offset, or merge into the side wall, adjacent to the plate 5, so that the band, belt or strap can be continuously guided by the cheeks 6,6'. As is particularly apparent from FIG. 4, the plate 5 and the cover 2 have rounded ends and the long arm 3 of the cover 2 slightly protrudes beyond the plate 5 so that said long arm 3 can easily be grasped when the cover 2 is to be opened.

The plate 5 is formed in its upper surface with a recess 12, which tapers forwardly in depth and which receives the short arm 4 when the cover 2 is in its closed position. Between that recess and the forward end of the plate 5 the latter is formed with three slots 9, 9',9'', which extend transversely to the longitudinal direction of the buckle and through which one of the two bands to be joined can be threaded. In dependence on the sequence in which the band is threaded through the slots the band can be held in a permanent or adjustable position.

In case the buckle need not be adjusted to the girth of the body of the wearer and is adjusted relative to the bands to be joined whenever the buckle is closed, at least one additional slot 13 is provided in the plate 5 in the rear portion of the latter, which rear portion is shorter than the forward portion formed with the slots 9,9',9''. That slot 13 is parallel to the slots 9,9',9'' and has the saae length and width as each of the slots 9,9',9'' and is adapted to receive the band, belt or strap that is to be connected. For this purpose the end of that band, belt or strap is inserted between the shorter arm 4 of the open cover 2 and the plate 5. When the cover 2 has been closed its arm 4 will force the band, belt or strap into the recess 12 to hold the band, belt or strap in position.

Figure 1:
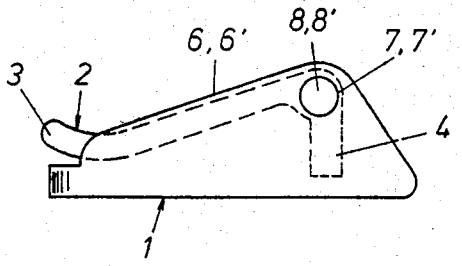
FIG. 1 is a side elevation showing the buckle in its closed position.
Figure 2:
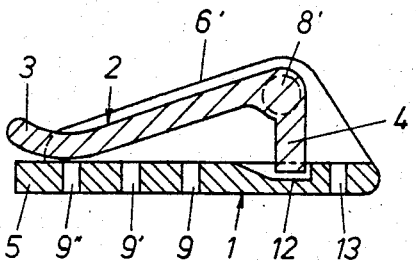
FIG. 2 is a sectional view taken along II—II in FIG. 3.
Figure 3:
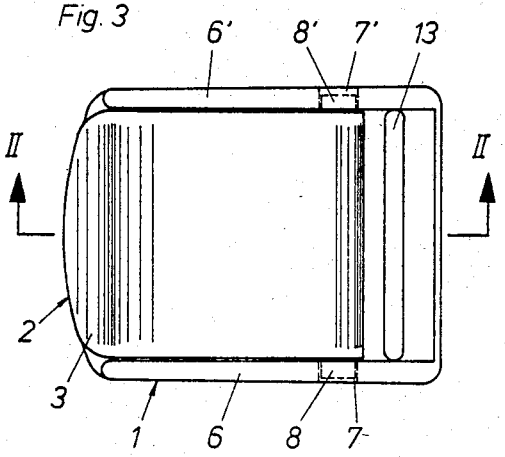
FIG. 3 is a top plan view showing the buckle of FIG. 1.
Figure 4:
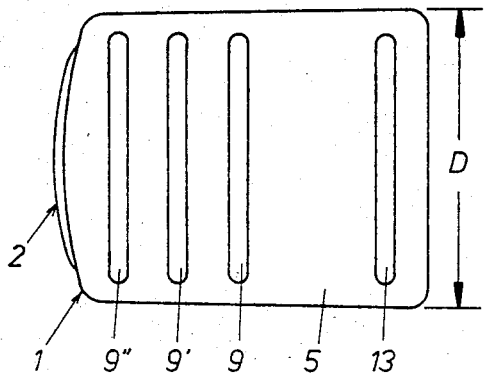
FIG. 4 is a bottom view showing the buckle of FIG. 2.
Figure 5:
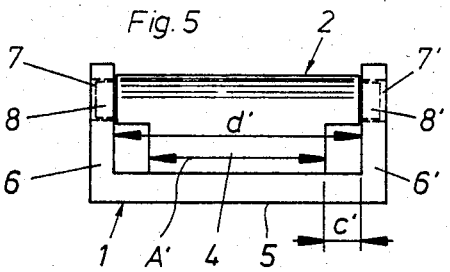
FIG. 5 is a rear view showing the buckle of FIG. 1.
Figure 6:
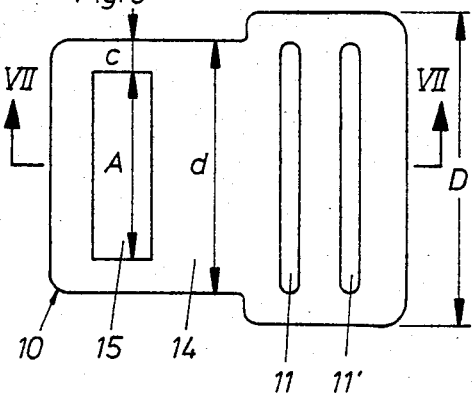
FIG. 6 is a top plan view showing the slider.
Figure 7:
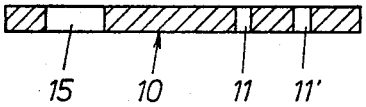
FIG. 7 is a sectional view taken on line VII—VII in FIG. 6.
Figure 8:
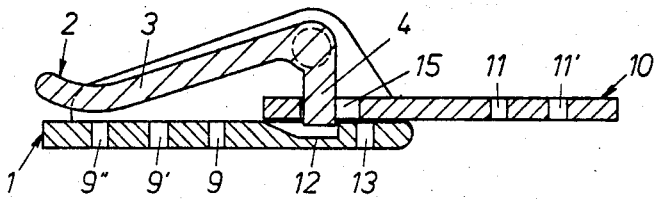
FIG. 8 is a central longitudinal sectional view showing the buckle of FIG. 1 with the slider shown in FIGS. 6 and 7 in inserted position.

It may be desired to permanently adjust the buckle for the body of a given wearer and to eliminate the need for a readjustment before the buckle is closed as long as the girth of that body has not been changed. For this purpose a slider 10 is provided, which has at least one slot and in the present case has two slots 11,11' for receiving the end of one band, belt or strap to be fixed. That end is inserted into slots 11,11' in such a manner that the slider is fixed to that end. Alternatively, the slider may be connected to a loop, which extends through at least one of the slots 11,11' and is sewn to the jacket. The width D of the slider is equal to the width of the buckle (FIGS. 4 and 6). The forward portion or extension 14 of the slider is offset and can be inserted between the shorter arm 4 of the open cover 2 and the plate 5. For the fixation of the slider in the buckle body, the slider 10 has an aperture 15 in which the cover is latched as it is closed, as is apparent from FIG. 8. In that embodiment one band, belt or strap is clamped at its end in the slots 9,9',9" of the plate 5 and the other band, belt or strap is fixed to the slider 10 so that the jacket can be closed simply in that the buckle body is connected to the slider.

It will be understood that various changes in design can be adopted within the scope of the invention and the buckle may be used also for purposes other than those mentioned in the opening part of the description. If the buckle is used in brassieres for breastfeeding mothers, as mentioned hereinbefore, the buckle may be attached like the fastener disclosed in Austrian Patent Application A 1441/80 so that the buckle provides a releasable connection between the strap for the outer cup of the brassiere and the strap for an inner cup of the brassiere, which inner cup is provided with a breast-feeding opening, and the buckle is secured to the main strap of the brassiere. In that case the plate 5 is secured at its slot 13 to the strap extending from the inner cup and is secured at one of the slots 9,9', 9" to the strap which continues the strap mentioned first and extends over the shoulder and on the back of the wearer is secured to the back strap. The slider 10 is fixed at one of its slots 11,11' to one strap for the outer cup; that strap overlies the above mentioned strap extending from the inner cup. As a result, the slider 10 can be inserted in the manner described hereinbefore between the opened cover 2 and the plate 5 so that the outer cup is disposed over the lower one and covers the breast-feeding opening of the inner cup. As the cover is closed, the slider 10 is fixed in that position When it is desired to turn down the outer cup so that the breast is exposed for breast feeding, the cover 2 is swung open so that the slider is released.

The width d of the part i4 is suitably slightly smaller than the clearance d' between the cheeks 6,6' so that the part 14 can easily be inserted between the cheeks 6,6'. The length A of the aperture 15 slightly exceeds the width A' of the arm 4 so that the clearance c' between the arm 4 and each of the cheeks 6, 6' exceeds the width c of the lands on opposite sides of the aperture 15.

Figure 10:
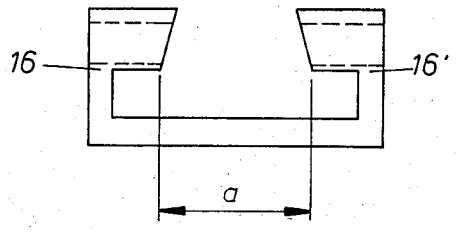
FIG. 10 is a rear view showing the buckle body of FIG. 9.

The surface which is oblique in FIG. 10 may be at right angles to the baseplate 5.

The opening 12 may extend from one cheek 6 to the other cheek 6' and may extend through the plate 5 or through part of the thickness thereof.

What I claim is:

1. A buckle comprising a buckle body having a plate for receiving a band which is to be releasably fixed, said plate being provided on opposite sides with cheeks protruding from the plate at right angles thereto, said buckle also comprising an angled cover having a long arm and a short arm and pivoted to said cheeks directly at a bend between said arms at an axis lying in said bend, said long arm constituting an actuating lever and said short arm when the cover is in its closed position extending into a nonthroughgoing recess directly below said axis formed in said plate and open only toward said cover, said recess extending transversely to said band and through only part of the thickness of said plate, said recess having a depth tapering in a direction of swing of said short arm, and a slider secured to said band, said slider having an aperture for receiving said short arm, said short arm of said cover having a width which is slightly smaller than a spacing between said cheeks, said cheeks being provided with wedge-shaped projections spaced from said plate and which define between them a space which increases in width toward a forward end of the plate and also increases in width toward said plate, said projections overhanging said plate so that said band in said space passes between said projections and said plate.

2. A buckle according to claim 1 wherein said cover is resiliently biased toward a closed position by said projections.

3. A buckle according to claim 2 wherein said cover is engaged by said projections at said long arm.

* * * * *